US007377068B2

(12) United States Patent
Musser

(10) Patent No.: US 7,377,068 B2
(45) Date of Patent: May 27, 2008

(54) METHOD AND APPARATUS FOR FITTING AND AIMING A FIREARM

(76) Inventor: Stephen R. Musser, 713 Canterbury, College Station, TX (US) 77845

( * ) Notice: Subject to any disclaimer, the term of this patent is extended or adjusted under 35 U.S.C. 154(b) by 229 days.

(21) Appl. No.: 11/248,404

(22) Filed: Oct. 12, 2005

(65) Prior Publication Data

US 2007/0240357 A1 Oct. 18, 2007

(51) Int. Cl.
*F41G 1/38* (2006.01)

(52) U.S. Cl. ..... 42/121; 42/111; 42/135

(58) Field of Classification Search ..... 42/111, 42/121, 135

See application file for complete search history.

(56) References Cited

U.S. PATENT DOCUMENTS

| | | | | |
|---|---|---|---|---|
| 722,844 | A | 3/1903 | Hubbard | |
| 1,222,620 | A | 4/1917 | Gaynor et al. | |
| 2,090,658 | A * | 8/1937 | Zak | 33/262 |
| 2,553,540 | A | 5/1951 | Beckerman | |
| 5,471,777 | A | 12/1995 | McDonald | |
| 5,499,455 | A * | 3/1996 | Palmer | 42/120 |
| 5,953,165 | A | 9/1999 | Stolov | |
| 6,321,479 | B1 | 11/2001 | Sheehan | |
| 6,604,315 | B1 | 8/2003 | Smith et al. | |
| 2003/0177685 | A1 * | 9/2003 | Pinkley | 42/135 |
| 2005/0072035 | A1 | 4/2005 | McClimond | |

* cited by examiner

*Primary Examiner*—Michael Carone
*Assistant Examiner*—Gabriel J Klein
(74) *Attorney, Agent, or Firm*—Tod T Tumey

(57) ABSTRACT

An apparatus and method are disclosed for determining a proper firearm fit for a user. In an embodiment, a firearm alignment device is disclosed. The firearm alignment device comprises a reflective surface and an opening. In addition, the firearm alignment device includes a band. The band may be horizontally disposed on the reflective surface.

8 Claims, 6 Drawing Sheets

METHOD AND APPARATUS FOR FITTING AND AIMING A FIREARM

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to firearms, and more particularly relates to firearm aiming sights. Still more particularly, the present invention relates to a method and apparatus for determining a firearm user's proper fit in relation to the firearm aiming sight.

BACKGROUND

Firearms require skill and consistency of use in order to accurately aim and discharge the weapon at an intended target. In order to aim a firearm, the user typically lines up the aiming sight of the firearm with a target in the user's field of vision. The aiming sight of most firearms includes a bead or other protrusion at the end of the firearm barrel, and an open sight or rib disposed on the barrel closer to the user. The user typically places the user's chin into contact with the firearm stock while tightly holding the firearm stock against the user's shoulder. The user then lines up the open sight or rib, the bead, and the target in the field of vision of the user as the user looks down the barrel of the firearm.

Traditional firearms such as rifles, shotguns, and pistols are typically not made to fit the varying physical attributes of an individual user. In particular, the length of a firearm user's arms and neck, as well as the distance between a firearm user's chin and eye, can impact whether a firearm fits the user. As a result, it may be difficult for some users to properly align their head and eye positions such that the user's field of vision is straight down the barrel and through the aiming sight in a manner that results in precise aiming of the firearm. Without achieving head and eye positions that are level to the firearm barrel, the firearm user's vision may be skewed, making it difficult to take accurate aim.

Firearms can be modified to provide the proper fit for a user according to a user's unique physical attributes. Modifications of this nature are often performed by a gunsmith or firearm vendor and can add an unanticipated expense after the purchase of the firearm. Moreover, the ability to determine the proper fit for a firearm user typically remains an inexact science, usually relying on trial and error of firearm modification. Therefore, a need exists for an accurate method and apparatus that allows a firearm user to determine the manner and amount of firearm modification necessary to promote the proper head and eye positions for accurate aiming of the firearm.

SUMMARY OF THE PREFERRED EMBODIMENTS

In an embodiment, these and other needs in the art are addressed by a firearm alignment device. The firearm alignment device comprises a reflective surface and an opening.

The firearm alignment device also comprises a band, wherein the band is horizontally disposed on the reflective surface.

In another embodiment, these and other needs in the art are addressed by a method for aiming a firearm. The method comprises providing a firearm alignment device, wherein the firearm alignment device comprises a reflective surface and a band. The method further comprises positioning the firearm alignment device on a barrel of the firearm, wherein the firearm alignment device provides a user image. In addition, the method comprises aligning the image with the band to aim the firearm.

An additional embodiment addresses these and other needs in the art by a method for positioning a firearm alignment device to a firearm. The method comprises passing a barrel of the firearm through an opening in the firearm alignment device. The method further comprises securing the firearm alignment device to the barrel. In addition, the method comprises providing a user image in a reflective surface of the firearm alignment device.

The firearm alignment device overcomes problems with conventional alignment and fitting devices. For instance, the firearm alignment device allows the user image to be used to quickly fit the user to the firearm. In addition, the firearm alignment device allows the user image to be used to practice accurately aiming the firearm by proper alignment of the image in the reflective surface.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more detailed description of the embodiments, reference will now be made to the following accompanying drawings, wherein.

DETAILED DESCRIPTION OF THE EMBODIMENTS

Figure 1:
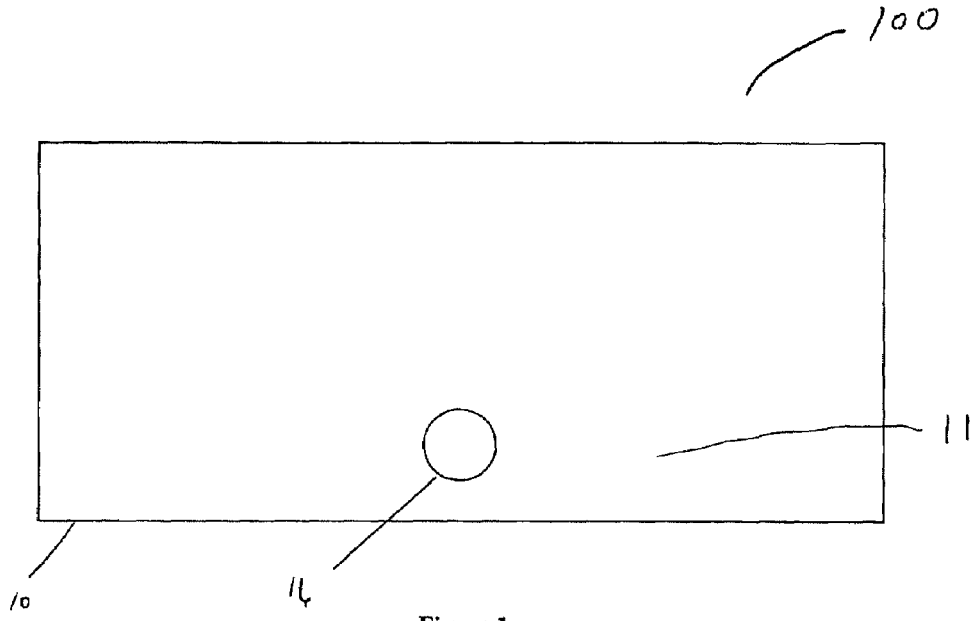
FIG. 1 illustrates a firearm alignment device having a reflective surface and an opening.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 illustrates a firearm alignment device 100 having a reflective surface 10 and an opening 16. In certain embodiments, reflective surface 10 may comprise a suitable size and shape for disposal at the end of a firearm barrel. Reflective surface 10 may comprise any material that may show the reflection of an image, such as glass or stainless steel. In an embodiment, reflective surface 10 comprises a glass mirror. Opening 16 may be disposed at any location on reflective surface 10 suitable for receiving a firearm barrel. In an embodiment, opening 16 is disposed in a lower portion 11 of reflective surface 10. Opening 16 may be of a size and shape suitable for a firearm barrel to pass therethrough. In an embodiment, opening 16 comprises a substantially circular shape.

Figure 2:
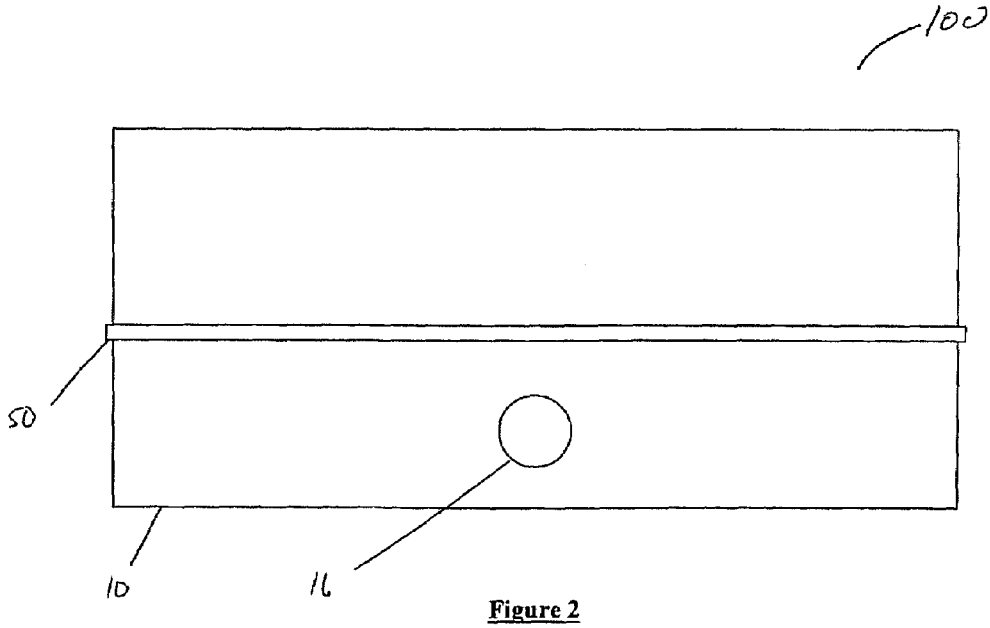
FIG. 2 illustrates a firearm alignment device having a reflective surface, an opening, and a band.

FIG. 2 illustrates a firearm alignment device 100 having reflective surface 10, opening 16, and band 50. Band 50 may comprise any material suitable for marking a horizontal position across at least a portion of reflective surface 10. In certain embodiments, band 50 may comprise material that is elastic, stretchable, or the like. In an embodiment, band 50 comprises rubber. For instance, band 50 may be a rubber band. Alternatively, band 50 may be substantially non-stretchable (e.g., comprised of a metal, plastic, woven material, or the like). Band 50 is disposed on reflective surface 10 above opening 16 and is oriented substantially horizontal with respect to reflective surface 10. In certain embodiments, band 50 is wrapped around reflective surface 10 and secured in position by the elasticity of band 50. Alternatively, band 50 may be secured to reflective surface 10 by varying methods, such as by adhesive or magnets. In another alternative embodiment, band 50 may be disposed just off or on reflective surface 10 and secured in position by clips, hooks, or the like.

Figure 3:
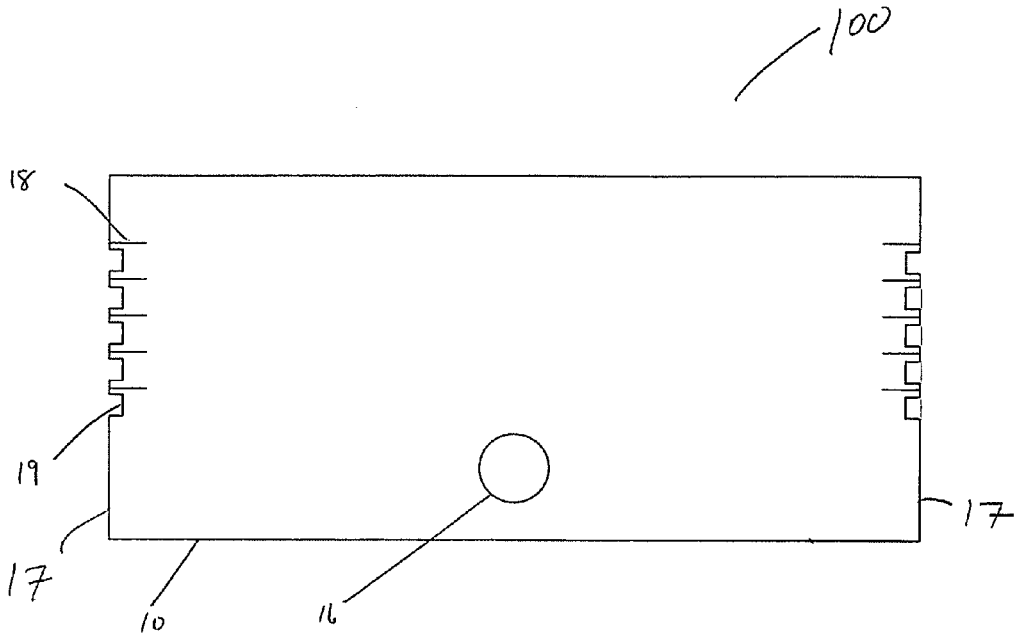
FIG. 3 illustrates a firearm alignment device having a reflective surface, opening, horizontal reference markers, and notches.
Figure 4:
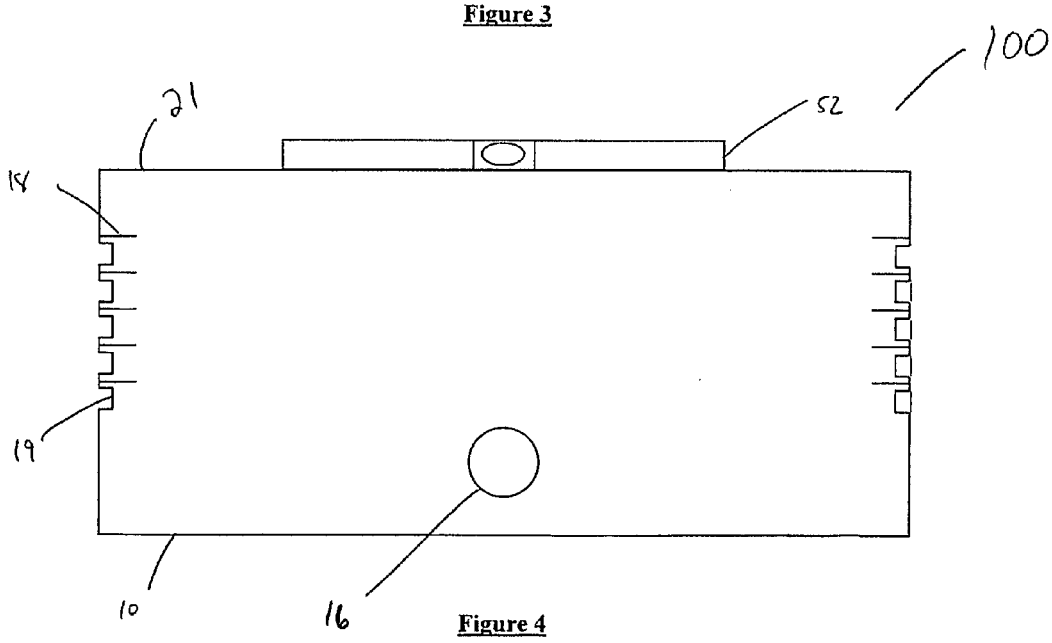
FIG. 4 illustrates a firearm alignment device having a reflective surface, opening, horizontal reference markers, notches, and a level.

FIG. 3 illustrates an embodiment in which reflective surface 10 further includes horizontal reference markers 18 and notches 19. It is to be understood that the number of horizontal reference markers 18 and notches 19 shown in FIG. 3 are for illustrative purposes only as firearm alignment device 100 may comprise any suitable number of horizontal reference markers 18 and/or notches 19. Horizontal reference markers 18 may comprise any suitable indication for showing an elevation of reflective surface 10. Firearm alignment device 100 may comprise at least one set of horizontal reference markers 18. Each set of horizontal reference markers 18 are paired, coplanar, and are oriented on reflective surface 10 in a manner so that each set is vertically parallel to the others. In certain embodiments, reflective surface 10 has at least one set of notches 19. Notches 19 are located on each vertical side 17 of reflective surface 10 and may correspond to a set of horizontal reference markers 18 and/or to a desired elevation of reflective surface 10. In alternative embodiments (not illustrated), firearm alignment device 100 comprises at least one set of notches 19 or at least one set of horizontal reference markers 18. Without being limited by theory, horizontal reference markers 18 and notches 19 allow band 50 to be horizontally leveled with reflective surface 10. In other alternative embodiments (not illustrated), firearm alignment device 100 comprises a level. For instance, as illustrated in FIG. 4, level 52 may be disposed on top 21 of reflective surface 10. Level 52 may comprise any suitable device and be positioned at any suitable location to determine an object's tilt orientation with respect to the ground or support that is supporting the user. Without limitation, an example of a suitable level is a bubble-type indicator.

Figure 5:
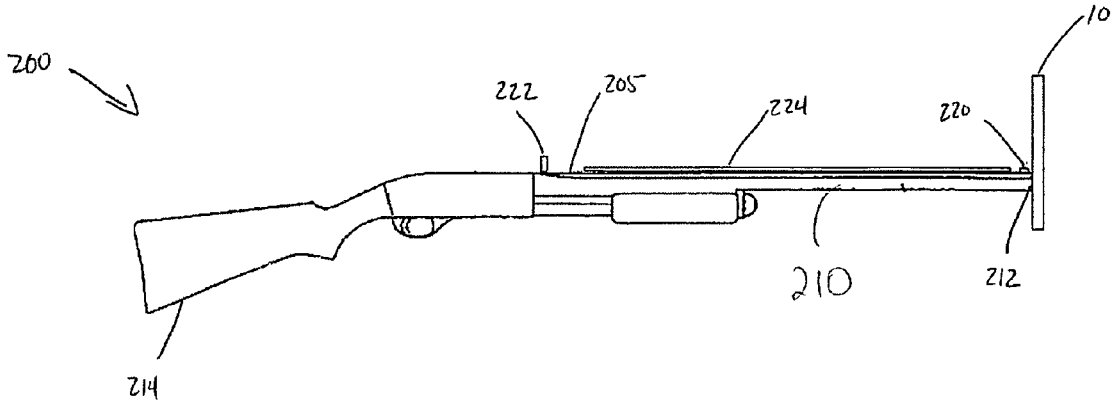
FIG. 5 illustrates a firearm with a firearm alignment device disposed at the end of the barrel.

Referring now to FIG. 5, a firearm 200 may comprise barrel 210, firing end 212, and stock 214. As shown in FIG. 5, firearm 200 is a shotgun, but it is to be understood that firearm 200 is not limited to a shotgun but may include any other firearm such as a pistol or rifle. Firearm 200 also includes bead 220, open sight 222, and rib 224. Bead 220 is mounted on top surface 205 of barrel 210 and near firing end 212. Rib 224 runs along the length of barrel 210 and is also located on top surface 205 of barrel 210. Open sight 222 is located on top surface 205 of barrel 210 in closer proximity to stock 214 than bead 220. A user may place firearm 200 in a firing position (e.g., simulated or actual) and aim firearm 200 by any suitable method. For instance, a firing position may be provided by the user placing stock 214 of firearm 200 into secure engagement with the user's shoulder, and then placing the user's chin in physical contact with stock 214. The field of vision of the user may be directed down the length of barrel 210 toward bead 220. Once firearm 200 is placed in a simulated firing position, the user may then aim firearm 200 by lining up a target (not shown), bead 220, and open sight 222 or rib 224 in the user's field of vision.

Figure 6:
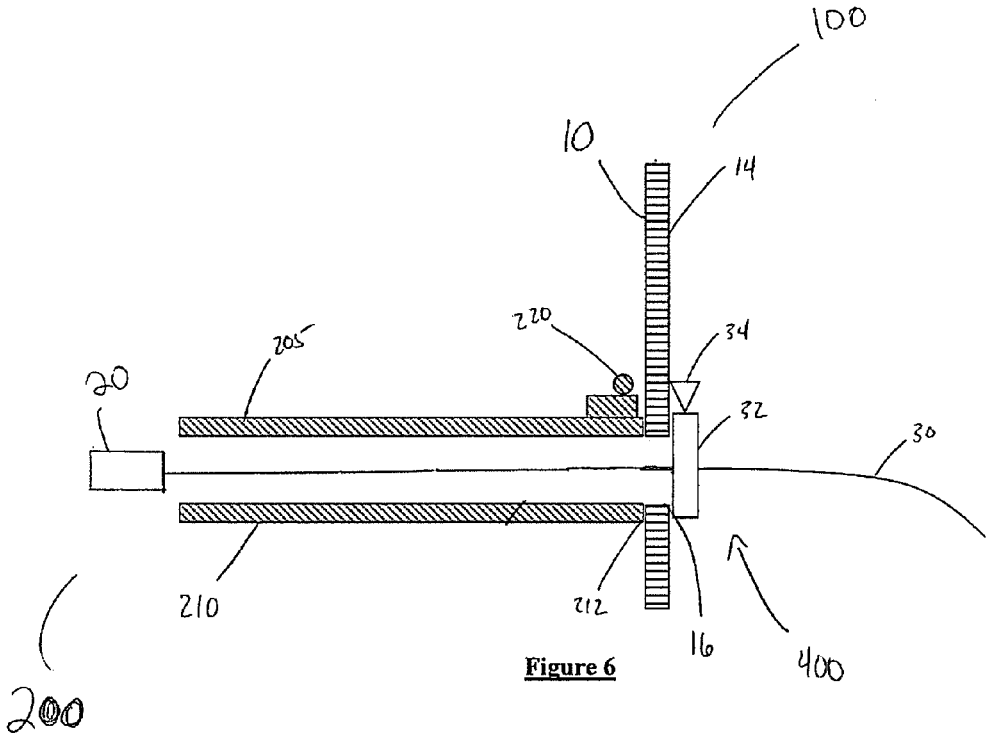
FIG. 6 illustrates a cross-sectional view of a firearm alignment device secured to the firearm with a cord and a clip.

It is to be understood that firearm alignment device 100 may be secured to firearm 200 by any suitable method. For instance, in one embodiment, an attachment device 400 as shown in FIG. 6 may be used to secure firearm alignment device 100 to firearm 200. FIG. 6 illustrates a cross-sectional view showing firearm alignment device 100 secured to barrel 210 with attachment device 400. It is to be understood that for illustration purposes FIG. 6 shows a portion of firearm 200 and barrel 210. Firearm alignment device 100 has a reflective surface 10 and back surface 14 and is disposed at firing end 212 of barrel 210 such that reflective surface 10 engages barrel 210. Attachment device 400 may comprise a plug 20, cord 30, and clip 32. Plug 20 may comprise any suitable material for insertion into a barrel. For instance, plug 20 may comprise a blank shell. Cord 30 is attached to plug 20. Cord 30 may comprise any suitable cord-like material. For instance, examples of suitable cord-like materials include string, elastic material (e.g., rubber band-like material, bungee cord-like material, and the like), nylon, and the like. Cord 30 may comprise any length suitable to provide at least a portion of its length to extend beyond firing end 212 and outside of barrel 210. A clip 32 is disposed on cord 30 and is movable along the length of cord 30 by sliding along the outer surface of cord 30. Clip 32 features a releasing tab 34 that secures clip 32 in position on cord 30. Clip 32 is released from engagement with cord 30 to slide clip 32 into a desired position by depressing releasing tab 34. The release of pressure on releasing tab 34 may lock clip 32 into position on cord 30. In an embodiment, plug 20 is loaded into firearm 200 in a manner sufficient to allow a portion of cord 30 to extend from barrel 210. For instance, plug 20 may be dropped into barrel 210, and cord 30 may be pulled to substantially secure plug 20. To secure firearm alignment device 100 to firearm barrel 210, firearm alignment device 100 is disposed such that cord 30 is inserted through opening 16 with reflective surface 10 facing the direction of firearm 200 and back surface 14 disposed away from firearm barrel 210. In such an embodiment, reflective surface 10 may be visible to the user while holding firearm 200 in a firing position. Releasing tab 34 on clip 32 is depressed to release clip 32, and clip 32 is moved along cord 30 until clip 32 engages back surface 14 of reflective surface 10. The pressure on releasing tab 34 is removed, thereby fixing clip 32 into secure engagement with cord 30 and firearm alignment device 100. Reflective surface 10 is held in position as a result of its secure engagement between barrel 210 and clip 32.

Figure 7:
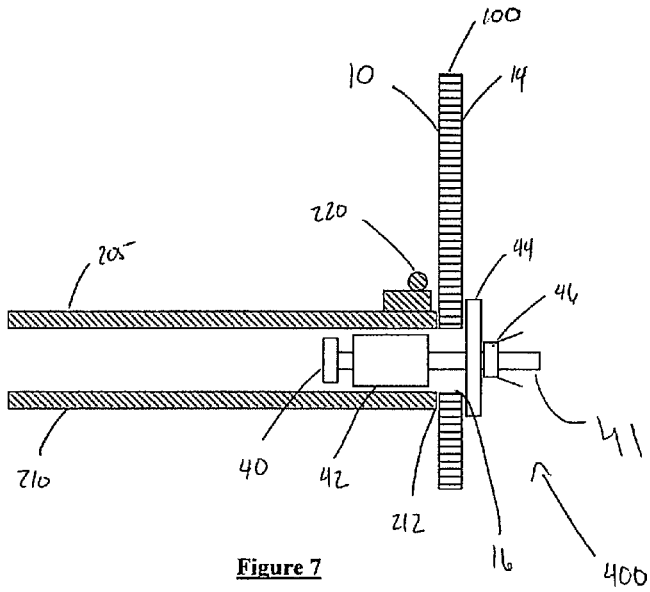
FIG. 7 illustrates a cross-sectional view of a firearm alignment device secured to the firearm with a bolt and a wing nut.

FIG. 7 illustrates a cross-sectional view of another embodiment of attachment device 400 in which attachment device 400 comprises a bolt 40, a well nut 42, a washer 44, and a wing nut 46. Bolt 40 and well nut 42 are inserted in that order into barrel 210, with a portion 41 of bolt 40 protruding from barrel 210. The protruding portion 41 of bolt 40 is inserted through opening 16 of firearm alignment device 100, and reflective surface 10 is engaged with firing end 212 of barrel 210. Washer 44 slides onto bolt 40 and engages back surface 14 of firearm alignment device 100. Wing nut 46 threadingly engages bolt 40 and is tightened until reflective surface 10 is tightly constrained between firing end 212 and washer 44. With reflective surface 10 secured in position at firing end 212, firearm 200 may be placed in a firing position.

Figure 8:
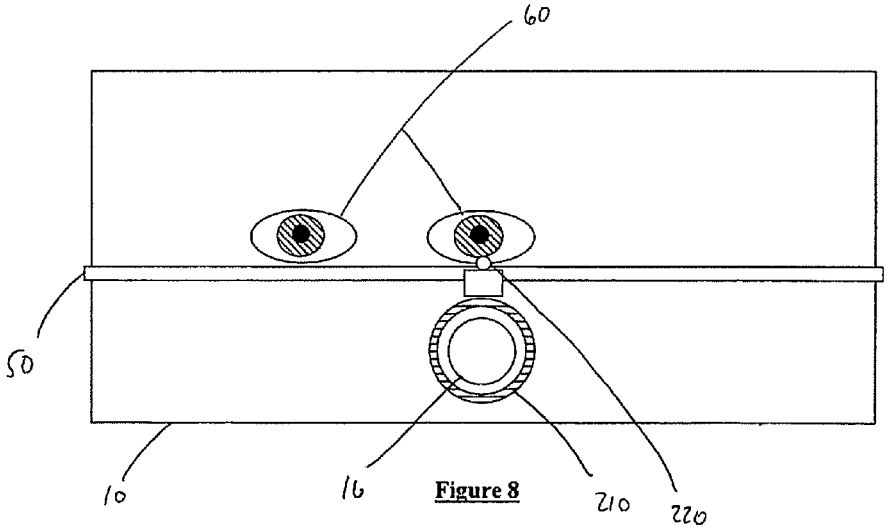
FIG. 8 illustrates a reflective surface, band, and user image.

FIG. 8 illustrates the firearm alignment device 100 shown in FIG. 2 secured to barrel 210. Reflective surface 10 with band 50 is shown within the user's field of vision. Band 50 is adjusted to be horizontal to reflective surface 10 and horizontally coplanar with bead 220. For instance, band 50 may be adjusted to the height of bead 220. In an embodiment, the user looks at reflective surface 10 and is able to see the user's image 60 in relation to bead 220 and band 50. It is to be understood that the user of firearm 200 refers to an individual that is aiming firearm 200. It is to be further understood that image 60 illustrated showing user's eyes is only representative of user's actual image as the actual image may show additional portions of user's image (e.g., face). The image 60 shown in FIG. 8 is for illustrative purposes only. In an embodiment, it is desired that the user's eyes in image 60 be lined up and coplanar with bead 220 and band 50. When the user's eyes as shown in image 60 are lined up horizontally coplanar (as shown) with band 50 and bead 220, the user is in the optimal firing position.

Figure 9:
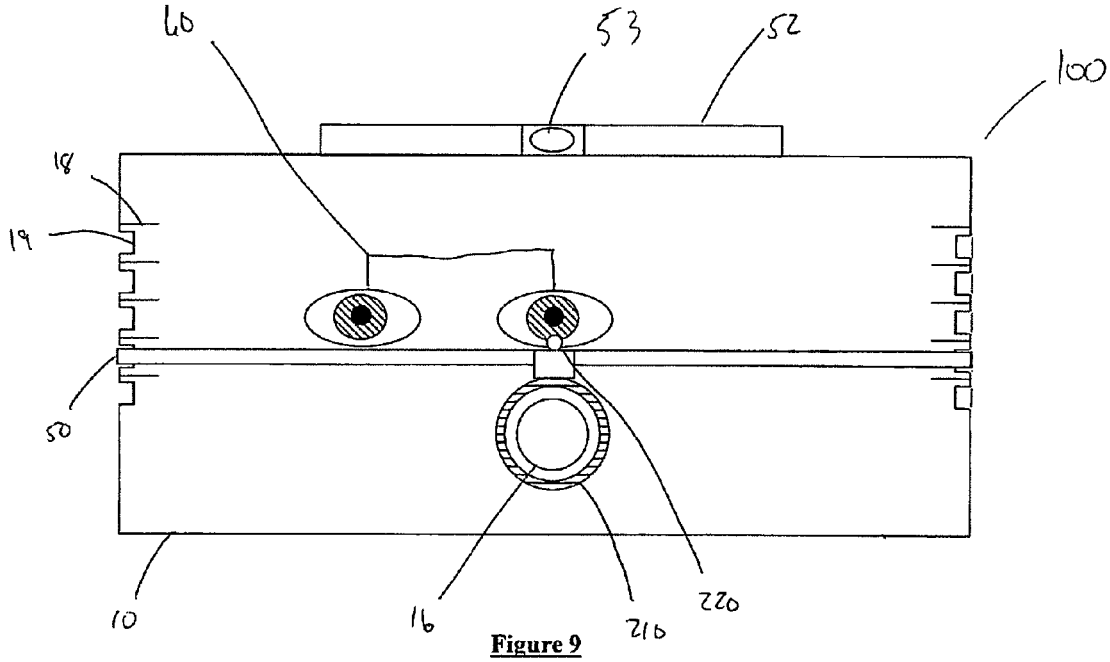
FIG. 9 illustrates a reflective surface, user image, level, and band.

FIG. 9 illustrates the firearm alignment device 100 shown in FIG. 4 secured to barrel 210. Band 50 is shown within the user's field of vision in reflective surface 10. As shown, band 50 is positioned in a set of notches 19 coplanar with bead 220. Band 50 is also horizontal to reflective surface 10. In an embodiment, it is desired that the user's eyes in image 60 be lined up and coplanar with reference to the appropriate set of horizontal reference markers 18 and also band 50 and bead 220. When the eye position in image 60 is lined up with bead 220 and band 50, the user is in the optimal firing position. Band 50 fits into notches 19 on reflective surface 10 and provides a horizontal reference in line with horizontal reference markers 18 that traverses a width of reflective surface 10. Without being limited by theory, such a reference allows the user's eyes in image 60 to be more easily lined up coplanar with bead 220. Level 52 may provide information regarding the orientation of reflective surface 10 with respect to the support (e.g., ground) upon which the user is located (e.g., standing or sitting). Reflective surface 10 may be oriented parallel to the support by positioning reflective surface 10 and level 52 such that level 52 indicates a parallel position (e.g., bubble 53 is in the center of level 52). The effect of leveling reflective surface 10 with the use of level 52 is to calibrate the orientation of reflective surface 10 such that when the user's eyes in image 60 are lined up coplanar with bead 220 and band 50, the user's eyes in image 60 are also coplanar with the ground.

Figure 10:
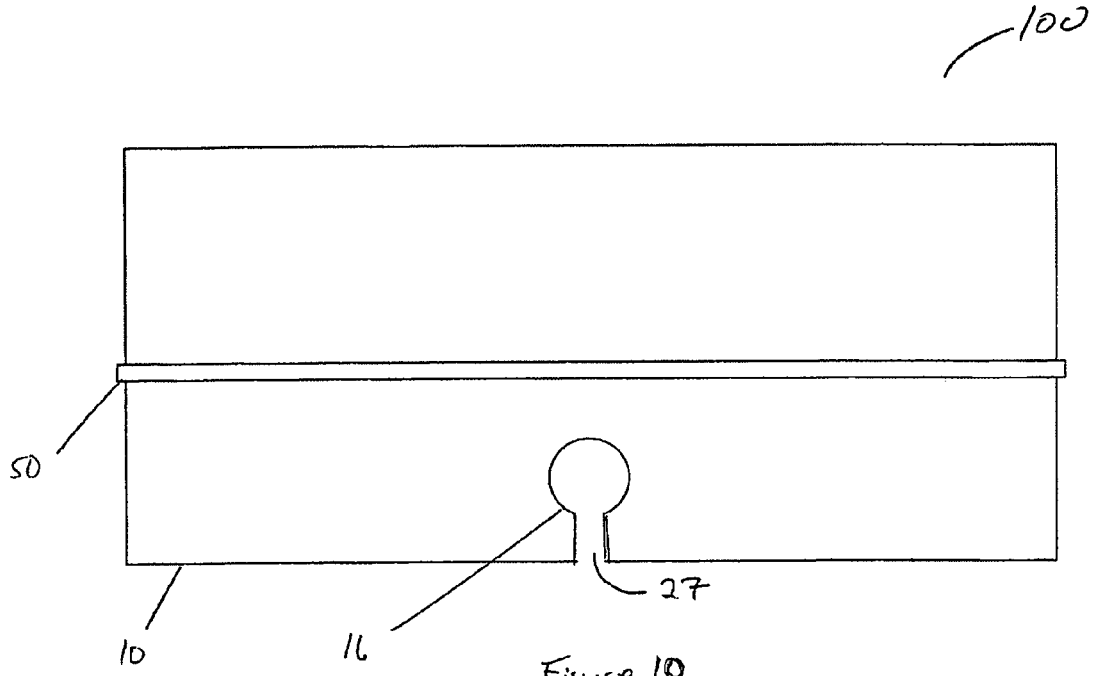
FIG. 10 illustrates a firearm alignment device having a reflective surface, opening, and a gap.

It is to be understood that firearm alignment device 100 is not limited to comprising an opening 16 as shown in the previous figures. Instead, in an alternative embodiment as shown in FIG. 10, firearm alignment device 100 comprises a gap 27. Gap 27 provides an aperture through firearm alignment device 100 to opening 16. In an embodiment, gap 27 may be of about the same width as cord 30. In another embodiment, gap 27 may have a sufficient width to allow cord 30 to pass up through gap 27 into opening 16 but also of sufficient width to allow cord 30 to remain in opening 16 until a sufficient force is applied to cord 30 to remove it from opening 16.

Once the user determines the user's optimal firing position through the use of firearm alignment device 100, firearm 200 may be modified to facilitate the user recreating the optimal firing position on an easily repeatable basis. Without being limited by theory, the user may improve the user's aiming practice and become a more precise and accurate marksman with the use of firearm alignment device 100. Further, without being limited by theory, firearm alignment device 100 may allow firearm 200 to be properly fit to a user. For instance, additions may be made to stock 214 to comfortably adjust user's position with firearm 200 to properly align image 60 in reflective surface 10.

While preferred embodiments of this invention have been shown and described, modifications thereof can be made by one skilled in the art without departing from the scope or teaching of this invention. The embodiments described herein are exemplary only and are not limiting. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A firearm alignment device, comprising:

a reflective surface, wherin the reflective surface provides an image;

an opening in the reflective surface for receiving a barrel of a firearm and a band, wherein the band is horizontally disposed on the reflective surface, and wherein the band comprises rubber.

2. The firearm alignment device of claim 1, wherein the reflective surface comprises glass.

3. The firearm alignment device of claim 1, farther comprising at least one set of horizontal reference markers.

4. The firearm alignment device of claim 3, wherein the band is coplanar with one of the at least one set of horizontal reference markers to provide the horizontal disposition of the band on the reflective surface.

5. The firearm alignment device of claim 1, farther comprising at least one set of notches.

6. The firearm alignment device of claim 5, wherein the band is disposed in one of the at least one set of notches to provide the horizontal disposition of the band on the reflective surface.

7. The firearm alignment device of claim 1, further comprising a level.

8. The firearm alignment device of claim 1, wherein the firearm alignment device is mountable on a firearm.

* * * * *